US006668811B1

(12) United States Patent
Kesler

(10) Patent No.: US 6,668,811 B1
(45) Date of Patent: Dec. 30, 2003

(54) IGNITION CONTROL CIRCUIT PROVIDING TEMPERATURE AND BATTERY VOLTAGE COMPENSATED COIL CURRENT CONTROL

(75) Inventor: Scott B. Kesler, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/607,752

(22) Filed: Jun. 30, 2000

(51) Int. Cl.[7] ..... F02P 3/12
(52) U.S. Cl. ..... 123/644; 123/609
(58) Field of Search ..... 123/625, 644, 123/609; 361/263; 315/224, 209

(56) References Cited

U.S. PATENT DOCUMENTS 4,538,585 A * 9/1985 Arguello et al. ..... 123/609
6,186,130 B1 * 2/2001 Skinner et al. ..... 123/625

* cited by examiner

*Primary Examiner*—Bibhu Mohanty
(74) *Attorney, Agent, or Firm*—Stefan V. Chmielewski

(57) ABSTRACT

An automotive ignition system (50) includes a control circuit (52) operable to drive a coil current switching device (24) connected between an ignition coil (30) referenced at battery voltage ($V_{BATT}$) and a sense resistor ($R_S$) referenced at ground potential. The control circuit (52) includes a drive circuit (20) and voltage trip circuit (54) defining a reference voltage ($V_{TH}$) for comparison with a sense voltage ($V_S$) developed across the sense resistor ($R_S$) due to increasing coil current ($I_C$) through the ignition coil (30). As the sense voltage ($V_S$) increases to the reference voltage ($V_{TH}$), the voltage trip circuit (54) produces a trip voltage signal ($V_{TRIP}$) to which the drive circuit (20) is responsive to deactivate the coil current switching device (24). The voltage trip circuit (54) is configured such that the reference voltage ($V_{TH}$) is temperature and battery voltage, and optionally engine speed, dependent. The trip voltage signal ($V_{TRIP}$) thus carries this same dependency so that ignition coil charging time may be. optimally controlled under varying temperature, battery voltage, and optionally engine speed, conditions.

14 Claims, 4 Drawing Sheets

IGNITION CONTROL CIRCUIT PROVIDING TEMPERATURE AND BATTERY VOLTAGE COMPENSATED COIL CURRENT CONTROL

TECHNICAL FIELD

The present invention relates generally to circuitry for controlling automotive ignition systems, and more specifically to circuitry for detecting and terminating ignition coil current.

BACKGROUND OF THE INVENTION

Modem inductive-type automotive ignition systems typically control the ignition coil such that coil current is allowed to increase to a level high enough to guarantee sufficient spark energy for properly igniting an air/fuel mixture. The inductive nature of an ignition coil dictates that the coil current will increase over time, wherein a control circuit is typically operable to either terminate coil charging after a so-called "dwell time" and thereby initiate a spark event, or to dynamically maintain the coil current at a predefined current level for a predefined time period before initiating a spark event. The former technique, commonly referred to as "ramp and fire", is often preferable over the latter technique, commonly known as "ramp and hold", in that closed-loop stability is typically not an issue for concern in a ramp and fire system. Moreover, power dissipation in a coil current switching device is substantially reduced in a ramp and fire system since the switching device is only required to operate in a "saturated" mode with low voltage across its terminals. By contrast, a ramp and hold system requires linearly controlling the coil current such that the coil current becomes limited by the resistance of the ignition coils and the voltage across it. This requires increasing the voltage drop across the coil current switching device which then corresponds to a proportional increase in switching device power dissipation.

One known example of a "ramp and fire" ignition system 10 of the type just described is illustrated in FIG. 1, wherein system 10 includes an ignition control circuit 12 having an electronic spark timing (EST) buffer circuit 14 receiving an EST control signal from a control circuit 16 via signal path 18. The EST buffer circuit 14 buffers the EST control signal and provides a buffered EST control signal ESTB to a gate drive circuit 20. The gate drive circuit 20 is responsive to the ESTB signal to supply a gate drive signal GD to a gate 22 of an insulated gate bipolar (IGBT) transistor 24 or other coil switching device via signal path 26. A collector 28 of IGBT 24 is connected to one end of a primary coil 30 forming part of an automotive ignition coil having an opposite end connected to battery voltage $V_{BATT}$. An emitter 32 of IGBT 24 is connected to one end of a sense resistor $R_S$ having an opposite end connected to ground potential, and to a non-inverting input of a comparator 36 via signal path 38. An inverting input of comparator 36 is connected to a reference voltage VREF, and an output of comparator 36 supplies a trip voltage $V_{TRIP}$ to gate drive circuit 20.

In the operation of system 10, gate drive circuit 20 is responsive to a rising edge of an ESTB signal to supply a full gate drive signal GD to the gate 26 of IGBT 24. As IGBT 24 begins to conduct in response to the gate drive signal GD, a coil current $I_C$ begins to flow through primary coil 30, through IGBT 24 and through $R_S$ to ground, thereby establishing a "sense voltage" $V_S$ across resistor $R_S$. As the coil current $I_C$ increases due to the inductive nature of coil primary 30, the sense voltage $V_S$ across $R_S$ likewise increases until it reaches the comparator reference voltage VREF. At this point, the comparator 36 switches state and the corresponding change in state of the trip voltage $V_{TRIP}$ causes the gate drive circuit 20 to turn off or deactivate the gate drive voltage GD so as to inhibit the flow of coil current $I_C$ through the primary coil 30 and coil current switching device 24. This interruption in the flow of coil current $I_C$ through primary coil 30 causes primary coil 30 to induce a current in a secondary coil coupled thereto (not shown), wherein the secondary coil is responsive to this induced current to generate an arc across the electrodes of a spark plug connected thereto (not shown in FIG. 1).

One drawback to a ramp and fire ignition system of the type illustrated in FIG. 1 is that under low vehicle battery voltage ($V_{BATT}$) conditions, the resistance of the primary ignition coil 30 may limit the ability to achieve maximum coil current $I_C$. The resistance of primary coil 30 is typically a function of the physical construction of the coil 30, and is also a function of temperature with the resistance of coil 30 increasing as temperature increases. Under certain high temperature and low battery voltage operating conditions, the coil current $I_C$ therefore may not be able to increase to the level at which the corresponding sense voltage $V_S$ reaches the comparator reference voltage VREF. In operation under such conditions, the coil current $I_C$ may thus increase only to its resistively limited level with $V_S$<VREF, and remain at that level until some other control mechanism terminates the current ignition dwell event. For example, in some known ignition systems, such backup control is effectuated by a so-called "over-dwell" or "dwell timeout" timing circuit that commands the coil current switching device (e.g., IGBT 24) to turn off after some predetermined time period. However, in some ignition systems, such a dwell time extension may not be an acceptable strategy for addressing low coil current conditions that result in $V_S$<VREF.

What is therefore needed is an improved automotive ignition control strategy that addresses the foregoing drawbacks of known automotive ignition control systems.

SUMMARY OF THE INVENTION

The foregoing shortcomings of the prior art are addressed by the present invention. In accordance with one aspect of the present invention, an ignition control circuit comprises a comparator circuit defining a first input receiving a variable input signal, a second input and an output producing a trip signal, a first circuit producing a first current as a function of temperature, and a second circuit producing a second current, wherein the second current is a function of battery voltage below a predefined battery voltage threshold and otherwise zero, and wherein the first and second currents combine at the second input of the comparator circuit to define a reference level at which the trip signal changes state in response to the variable input signal.

In accordance with another aspect of the present invention, an ignition control circuit comprises a comparator circuit defining a first input receiving a variable input voltage, a second input and an output producing a trip signal, a first circuit supplying a reference voltage to the second input of the comparator, wherein the reference voltage is a function of temperature and of battery voltage and defines a reference level at which the trip signal changes state, and a second circuit responsive to a control signal to reduce the reference voltage to a predefined fraction thereof.

In accordance with a further aspect of the present invention, a method of producing a reference voltage for an ignition control circuit comprises the steps of establishing a first current as a function of temperature, establishing a second current, wherein the second current is a function of battery voltage below a battery voltage threshold and otherwise zero, combining the first and second currents and producing a reference voltage therefrom, and comparing a variable input voltage with the reference voltage and producing a trip signal based thereon.

One object of the present invention is to provide an improved automotive ignition control system by implementing an ignition control circuit defining a coil current trip level reference as a function of temperature and battery voltage.

Another object of the present invention is to provide such a circuit further defining the coil current trip level reference as a function of engine speed.

These and other objects of the present invention will become more apparent from the following description of the preferred embodiments.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
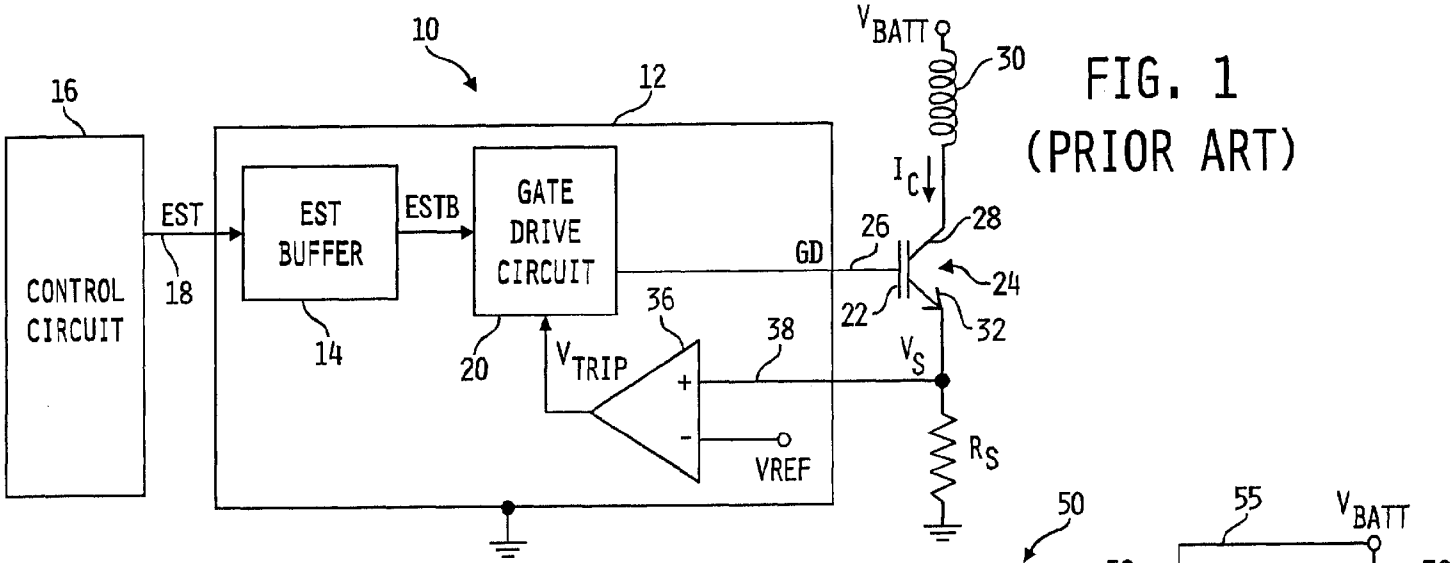
FIG. 1 (PRIOR ART)
FIG. 1 is a diagrammatic illustration of a prior art automotive ignition control system.
Figure 2:
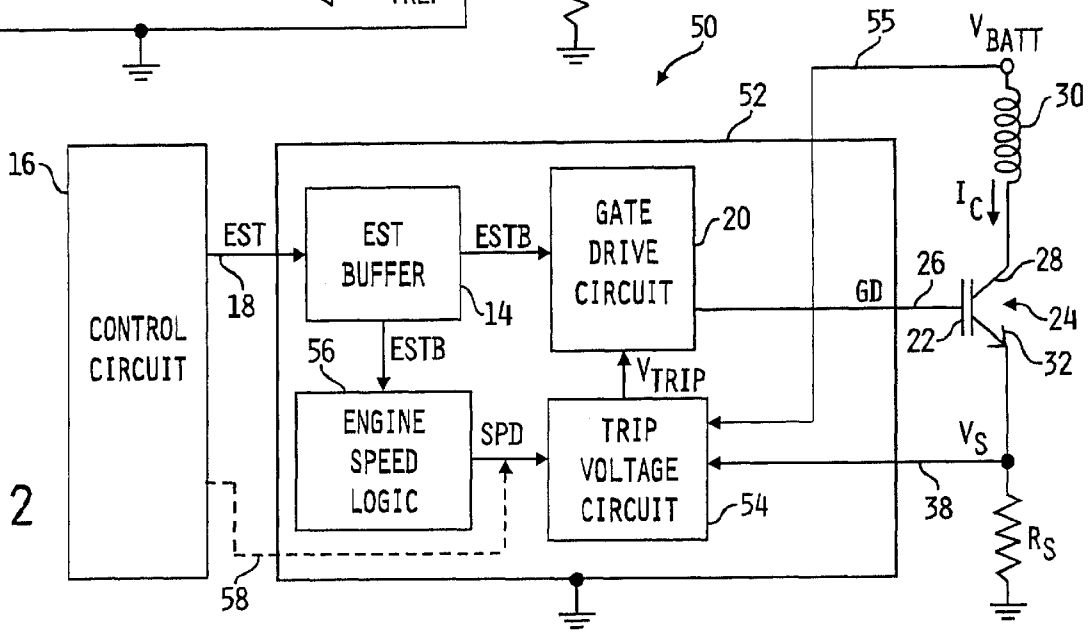
FIG. 2 is a diagrammatic illustration of one preferred embodiment of an automotive ignition control system, in accordance with the present invention.

Referring now to FIG. 2, one preferred embodiment of an automotive ignition control system 50, in accordance with the present invention, is shown. System 50 is similar in many respects to system 10 illustrated in FIG. 1, and like structure is therefore identified with like reference numbers. For example, system 50 includes a control circuit 16 producing an electronic spark timing signal (EST) for controlling spark events. Control circuit 16 is preferably a microprocessor-based control circuit including at least a memory and a number of input/output ports, and in one embodiment is a so-called engine (or electronic) control module (ECM) as this term is known in the art. Alternatively, control circuit 50 may be any known circuit operable to provide an EST control signal according a desired ignition control strategy. Like system 10, system 50 also includes a coil current switching device 24 which is, in one embodiment, an insulated gate bipolar transistor (IGBT) as shown in FIG. 2, but may alternatively be another power switching device of known construction including, but not limited to, a power metal-oxide-semiconductor field effect transistor (MOSFET), one or more bipolar transistors (e.g., single transistor or darlington configuration), one or more relays, or the like. In any case, system 50 will be described hereinafter as having an IGBT 24 with a gate 22, collector 28 and emitter 32, it being understood that device 24 may alternatively take the form of other known power switching devices such as any of those provided by example hereinabove. System 50, like system 10, further includes a primary coil 30 of an automotive ignition coil having one end connected to a source of battery voltage $V_{BATT}$ and an opposite end connected to the collector 28 of IGBT 24. The emitter 32 of IGBT 24 is connected to one end of a sensor resistor $R_S$ having an opposite end connected to ground potential.

System 50 also includes an ignition control circuit 50 similar in many respects to ignition control circuit 12 of FIG. 11, and like numbers are therefore used to identify like blocks of circuitry. For example, like circuit 12, circuit 52 includes an EST buffer circuit 14 of known construction receiving the EST signal from control circuit 16 and producing a buffered EST signal ESTB corresponding thereto. Also, like circuit 12, circuit 52 includes a gate drive circuit 20 of known construction receiving the ESTB signal from circuit 14 and producing a gate drive signal GD corresponding thereto, wherein the gate drive signal GD is supplied to the gate 22 of IGBT 24 via signal path 26.

Unlike circuit 12 of FIG. 1, circuit 52 includes an engine speed logic circuit 56 receiving the ESTB signal from EST buffer circuit 14 and producing a speed mode signal SPD indicative of an engine speed level. Alternatively, as shown in phantom in FIG. 2, control circuit 16 may be operable to provide the SPD signal either as a function of the EST signal or as a function of an engine speed signal typically provided thereto via an engine rotational sensor (not shown). In either case, circuitry providing the speed mode signal SPD is, in one embodiment, configured to produce SPD as a logic low level when engine speed, as indicated by the ESTB signal, is below a predefined engine speed threshold, and as a logic high level when the engine speed is at or above the predefined engine speed level. Alternatively, the circuitry may be configured to produce a high logic level signal when engine speed is below the predefined engine speed and a low logic level signal when engine speed is at or above the predefined engine speed level. In any either case, circuit 56 or 16 is preferably operable to force SPD to a first logic state when ESTB corresponds to an engine speed below a predefined engine speed level, and to force SPD to a second opposite logic state when ESTB corresponds to an engine speed at or above the predefined engine speed level, wherein circuit 56 or similar circuitry within circuit 16 may be of known construction and/or wherein construction of such a logic circuit is well within the knowledge of a skilled artisan. Circuit 52 further includes a trip voltage circuit 54 receiving the SPD signal from circuit 56 (or circuit 16) the sense voltage signal $V_S$ via signal path 38, corresponding to the voltage across sense resistor $R_S$, and battery voltage $V_{BATT}$ via signal path 55, wherein trip voltage circuit 54 is configured to supply a trip voltage $V_{TRIP}$ to gate drive circuit 20.

The operation of system 50 and of ignition control circuit 52 is identical in many respects to the operation of system 10 and of the ignition control circuit 12 of FIG. 2. For example, the EST buffer circuit 14 is responsive to the EST signal to supply a buffered EST signal ESTB to gate drive circuit 20 which is, in turn, responsive thereto to supply a gate drive signal GD to the gate 22 of IGBT 24 to thereby turn on IGBT 24 an begin conducting coil current $I_C$ therethrough from battery voltage $V_{BATT}$, through primary coil 30 and through sense resistor $R_S$ to ground potential. The sense voltage $V_S$ increases due to the increasing coil current $I_L$ through primary coil 30, and when $V_S$ reaches a reference voltage within trip voltage circuit 54, $V_{TRIP}$ switches state. When $V_{TRIP}$ changes state, this causes the gate drive circuit 20 to turn off or deactivate the gate drive voltage GD so as to inhibit the flow of coil current $I_C$ through the primary coil 30 and coil current switching device 24. This interruption in the flow of coil current $I_C$ through primary coil 30 causes primary coil 30 to induce a current in a secondary coil coupled thereto (not shown), wherein the secondary coil is responsive to this induced current to generate an arc across the electrodes of a spark plug connected thereto (not shown). Unlike the comparator 36 of ignition control circuit 12, however, the trip voltage circuit 54 of ignition control circuit 52 is configured such that the trip voltage signal $V_{TRIP}$ is a function of battery voltage $V_{BATT}$, temperature and engine speed level. The functional relationship between $V_{TRIP}$ and the combination of battery voltage and temperature is defined, in accordance with the present invention, such that the trip voltage $V_{TRIP}$ follows variations in coil current $I_C$ due to changes in battery voltage $V_{BATT}$ and temperature. Given that under low battery/high temperature operating conditions there is a fundamental limitation in the amount of energy that may be stored in the primary coil 30, terminating the current charging period at a coil current level lower than the "normal" trip level represents no additional loss in system performance. Additionally, if other system functions require termination of the dwell event after a period that is no longer than the time required to charge the primary coil 30 to the maximum achievable coil current level, a modified coil current trip mode of operation is desirable over a time-based control method. The trip voltage circuit 54 of the present invention is designed to provide for the termination of coil current charging period as a function of battery voltage and temperature without the need for timing circuitry. Additionally, due to heating of the ignition coil that may occur at high engine speeds, the ignition control circuit 52 of the present invention is designed to further reduce the coil current trip level as a function of engine speed so as to reduce the average power dissipated in the ignition coil.

Figure 3:
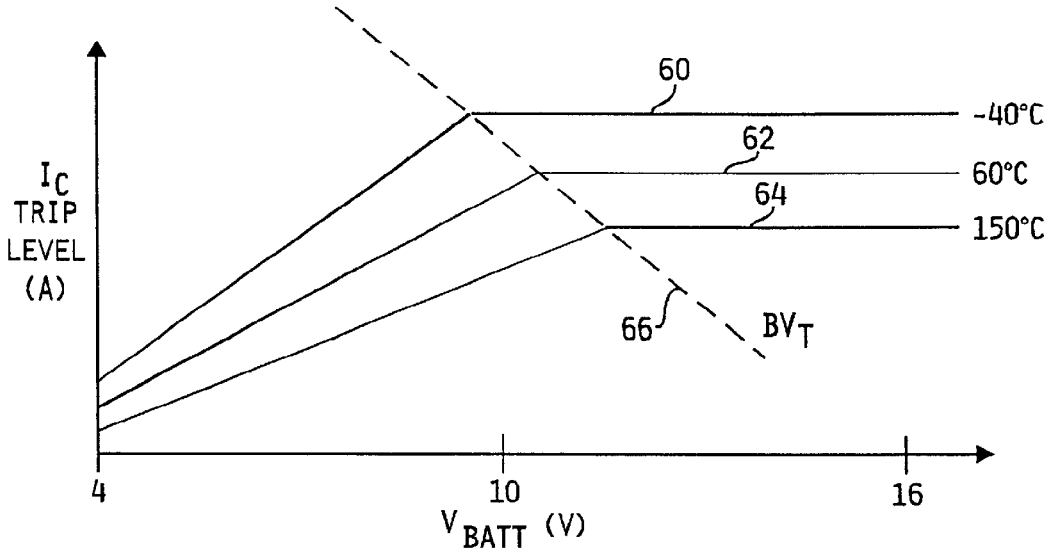
FIG. 3 is a plot of coil current trip level vs. battery voltage ($V_{BATT}$) for a number of operating temperatures illustrating a temperature and battery voltage dependence of the coil current trip level.

The particular characteristics of the battery voltage and temperature dependent behavior of trip voltage circuit 54 are generally determined by the specific structural and operational characteristics of the ignition coil. An example of typical battery voltage and temperature requirements, however, are illustrated in FIG. 3 for one known ignition coil embodiment, although it is to be understood that such requirements may require modification for use with other ignition coil embodiments. Those skilled in the art will recognize that such modifications will be within the knowledge of a skilled artisan, and that all such modifications are intended to fall within the scope of the present invention.

Referring now to FIG. 3, a plot of coil current trip level vs. battery voltage is shown at three different temperatures for an ignition coil of known construction. Curve 60 corresponds to coil current trip level vs. battery voltage at −40 degrees C. curve 62 corresponds to coil current trip level vs. battery voltage at 60 degrees C. and curve 64 corresponds to coil current trip level vs. battery voltage at 150 degrees C. Above a certain temperature-dependent battery voltage threshold $BV_T$, as shown by dashed-line 66, the coil current trip level is constant with battery voltage but varies with temperature. Thus, at battery voltages greater than $BV_T$, wherein $BV_T$ is a function of temperature, coil current trip level is a function only of temperature, and circuit 54 must accordingly be designed to reduce $V_{TRIP}$ at battery voltages above $BV_T$ so as to follow the temperature-dependent reduction in coil current trip level. At battery voltages below $BV_T$, the coil current trip level is dependent not only on temperature but also on battery voltage. Thus, at battery voltages less than $BV_T$, circuit 54 must be designed to reduce $V_{TRIP}$ as a function of both temperature and battery voltage to thereby follow curves 60–64. The battery voltage threshold $BV_T$ is a function of the temperature coefficients of the resistance of the primary coil 30 and, in the example shown, is a linear function of temperature.

Figure 4:
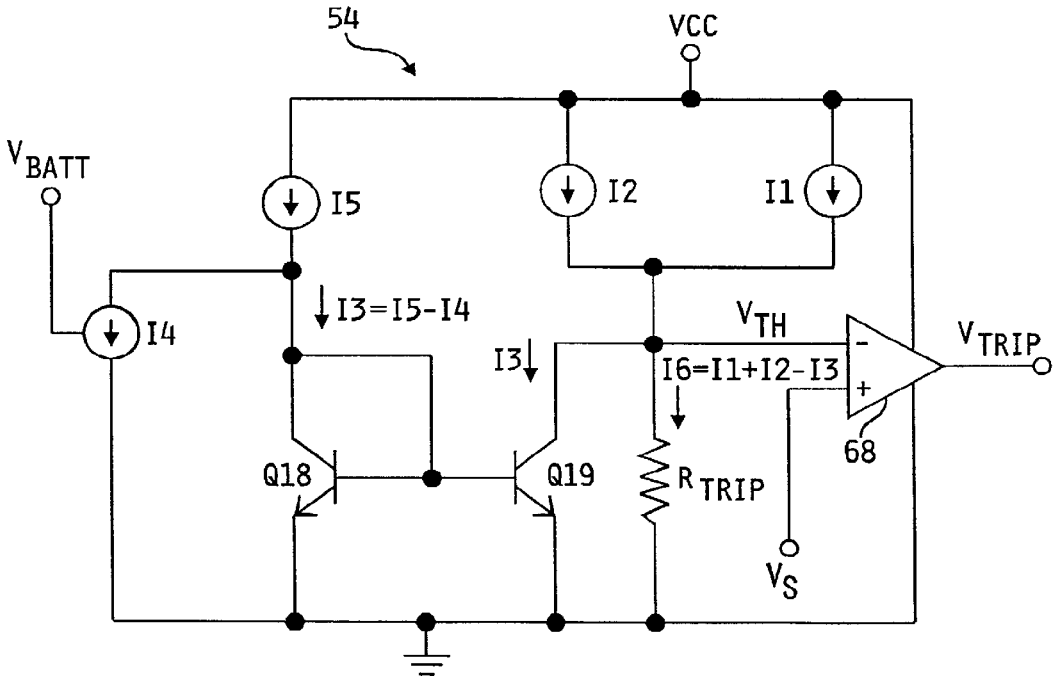
FIG. 4 is a simplified schematic diagram of one preferred embodiment of the trip voltage circuit of FIG. 2, in accordance with the present invention.

The trip voltage circuit 54 of the present invention is configured to monitor battery voltage $V_{BATT}$ and temperature, and to modify a reference voltage used to establish a current trip threshold level as a function of $V_{BATT}$ and temperature so that the trip voltage $V_{TRIP}$ produced by circuit 54 follows the coil current trip level function illustrated in FIG. 3. Referring now to FIG. 4, a simplified schematic diagram illustrating one preferred embodiment of the voltage trip circuit 54, in accordance with the present invention, is shown. Circuit 54 includes first and second current sources I1 and I2 connected between supply voltage VCC and an inverting input of a comparator 68, wherein a non-inverting input of comparator 68 receives the sense voltage $V_S$ developed across sense resistor $R_S$. Another current source I5 is connected between VCC and a collector of a NPN transistor Q18 and yet another current source 14 is connected between the collector of Q18 and ground potential such that a current I3 flowing through the collector of Q18 is defined by the composite current I5–I4. It should be noted that while Current sources I1, I2 and I5 are referenced to VCC, current source I4 is referenced to battery voltage $V_{BATT}$. The collector of Q18 is connected to is base and to a base of a NPN transistor Q19 with the emitters of Q18 and Q19 connected to ground potential. In this configuration, Q18 and Q19 form a current mirror such that the current I3 flowing through the collector of Q18 also flows through the collector of Q19 connected to the inverting input of comparator 68. A resistor $R_{TRIP}$ is connected between the inverting input of comparator 68 and ground potential such that a reference voltage $V_{TH}$ is defined by the composite current I6 I1+I2–I3 flowing therethrough. The output of the comparator 68 supplies the trip voltage $V_{TRIP}$.

Current source I1 is configured to supply a so-called "delta Vbe" current defined by the relationship I1=(Vt*ln (N))/RDVBE, wherein Vt is a thermal voltage, N is a ratio of emitter areas of NPN transistors used to develop the delta-Vbe current and RDVBE is a resistor sized to establish the magnitude of the current I1. The thermal voltage Vt is given by the well-known equation (k*T)/q, wherein "k" is Boltzman's constant, "T" is temperature in degrees Kelvin and "q" is the electronic charge. The current I1 thus has a positive temperature coefficient The current I2 is developed by impressing the base-to-emitter voltage (Vbe) of a NPN transistor across a silicon diffused resistor. The NPN Vbe has a negative T.C. and a typical silicon diffused resistor has a slight positive T.C. The resulting current I2 through the silicon diffused resistor thus has a negative T.C.

The current I5 is developed as a ratio of I1 and therefore has a positive T.C. The current I4 is developed by pulling current from the battery voltage line $V_{BATT}$ such that 14 is directly dependent upon $V_{BATT}$ and to a lesser extent on temperature from I5. The current I3 is defined by I3=I5–I4, and the current I6 flowing through $R_{TRIP}$ to establish $V_{TH}$ at the inverting input of comparator 68 is defined by I6=I1+I2–I3.

For operation at battery voltages above $BV_T$ (see FIG. 3), the coil current trip level is constant with battery voltage, and the threshold voltage $V_{TH}$ therefore need only be temperature dependent. Combining the positive T.C. of current I1 with the negative T.C. of current I2 in an appropriate ratio allows matching of the temperature coefficient of the reference voltage $V_{TH}$ with the temperature coefficient of the coil current trip level above $BV_T$. Since no battery voltage dependency is required of $V_{TH}$ above $BV_T$, the current I3 must be zero so that I6=I1+I2. Current sources 14 and 15 are accordingly designed such that for battery voltages $V_{BATT}$ greater than $BV_T$, I4 is greater than I5 so that current I4 pulls all available current away from the collector of Q18. With no positive current available to drive the current mirror composed of Q18 and Q19, no current flows into the collector of Q19 and the current I6 is accordingly equal to the sum of currents I1 and I2.

For battery voltages $V_{BATT}$ below $BV_T$, the current I4 is less than I5 and the composite current I3 therefore becomes non-zero. In this case, transistor Q18 mirrors the non-zero current I3 to the collector of Q19 so that the current I6, and therefore the reference voltage $V_{TH}$, is reduced thereby. The T.C. of $V_{TH}$ in this region of operation is defined by the temperature coefficients of the currents I1, I2, I4 and I5.

Figure 5:
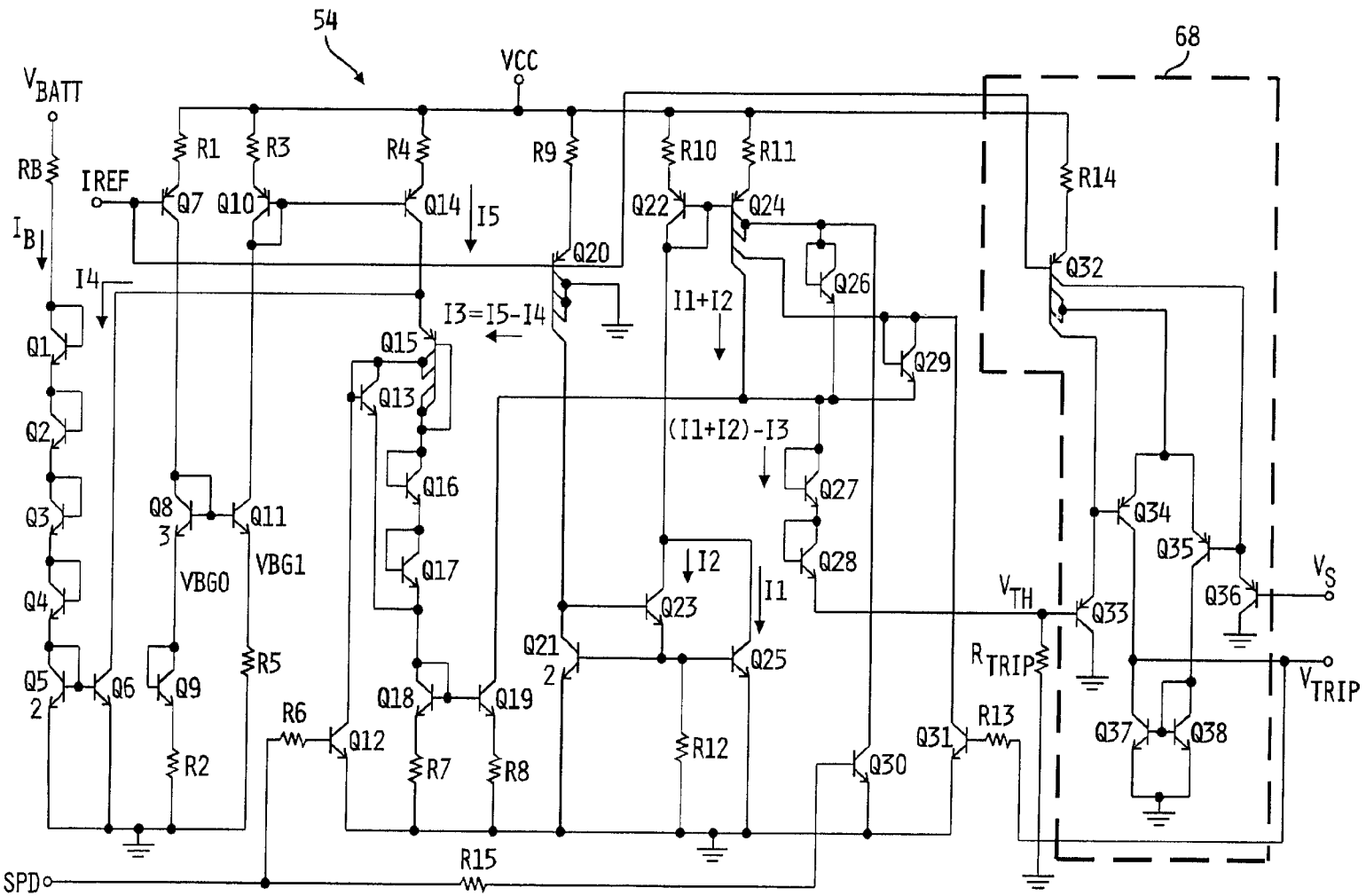
FIG. 5 is a device-level schematic diagram illustrating one preferred embodiment of the trip voltage circuit of FIGS. 2 and 4.
Figure 6:
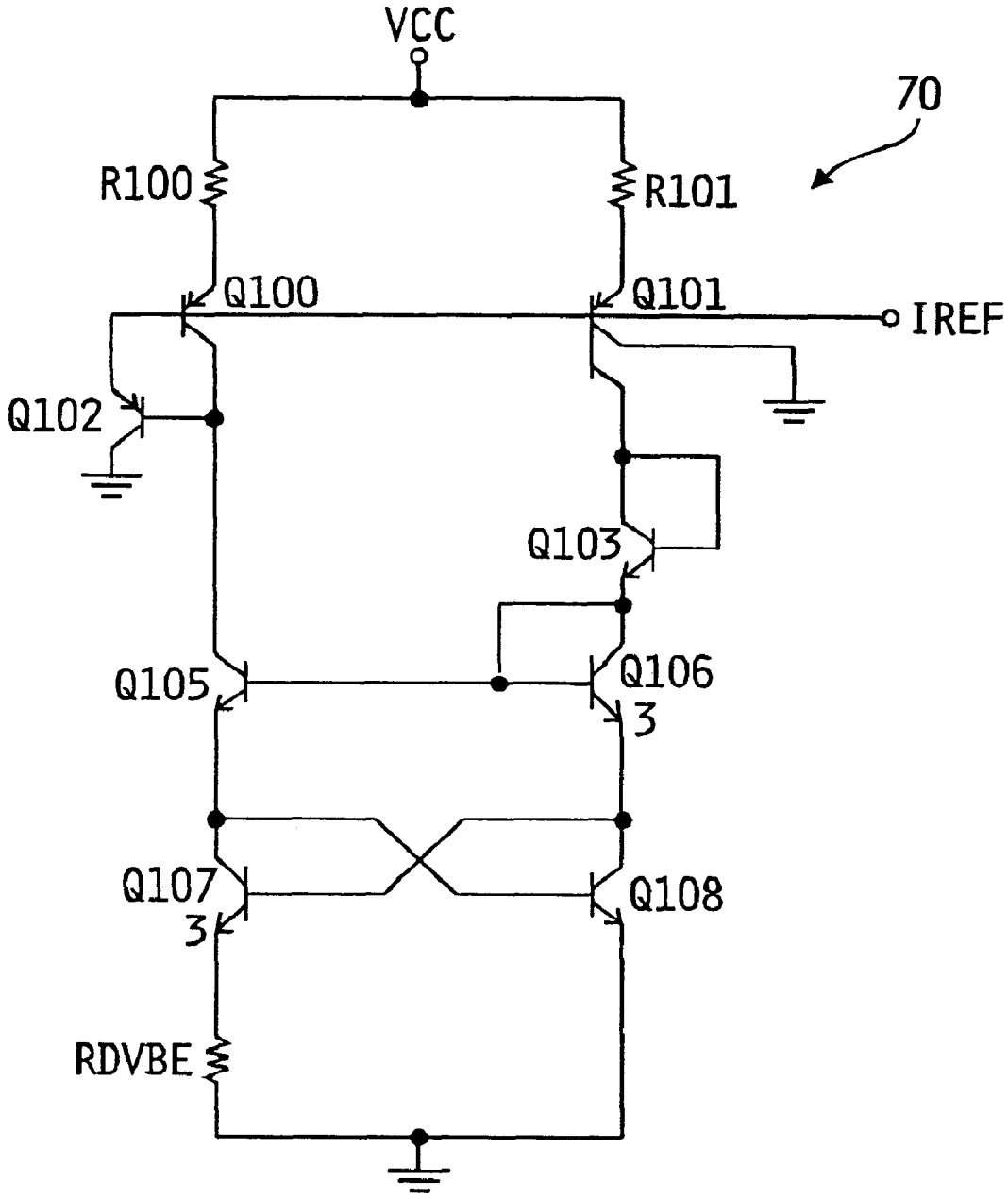
FIG. 6 is a device-level schematic diagram illustrating one preferred embodiment of a current generating circuit for use with the trip voltage circuit of FIG. 5.

Referring now to FIGS. 5 and 6, one preferred embodiment of the trip voltage circuit 54 and corresponding current generator circuit 70, in accordance with the present invention, is shown. In the illustration of the circuitry of FIGS. 5 and 6, any transistor shown having an integer associated with it emitter is to be understood to define an emitter area that is larger than a "standard" emitter area by the indicated integer number. Similarly, any transistor shown not having an integer associated with its emitter is to be understood to define a "standard" emitter area. The circuits 54 and 70 of FIGS. 5 and 6 are preferably combined to form an integrated circuit, preferably formed in accordance with a known silicon fabrication process, although the present invention contemplates forming these circuits 54 and 70 as one or more sub-circuits from discrete components, silicon integrated circuits and/or integrated circuits formed of other known semiconductor materials.

Setting up appropriate temperature coefficients of each of the four current sources I1, I2, I4 and I5 is crucial to achieving the final overall temperature characteristic of the threshold voltage $V_{TH}$, and details of this setup for the coil current trip level requirements illustrated in FIG. 3, will be described with respect to FIG. 5. It is to be understood, however, that modifications to the coil current trip level requirements will require corresponding modifications to the temperature coefficients of one or more of the current sources I1, I2, I4 and I5, and that such corresponding modifications will be apparent from the concepts described herein and which are intended to fall within the scope of the present invention.

The current I1 is a scaled representation of a "delta-Vbe" current, as described hereinabove, wherein the delta-Vbe current is developed by the circuit 70 illustrated in FIG. 6. Circuit 70 represents a known delta-Vbe current generator that develops a delta-Vbe current IREF with a slightly positive temperature coefficient at the circuit node labeled IREF. The circuit node labeled IREF in FIG. 5 receives the current IREF and forces a fraction of this current onto transistors Q21 and Q23 via the ¼ collector of transistor Q20. Transistors Q21, Q23 and Q25 define an NPN current mirror that further scales the ¼ IREF current forced onto the collector of Q21 (via ratios of transistor emitter areas) to thereby establish the desired magnitude of the resulting current I1 at the collector of Q25.

The current I2 is developed by forcing the base-to-emitter voltage of Q21 across silicon diffused resistor R12, thereby establishing the emitter current of Q23. I2 has a negative temperature coefficient due to a combination of the negative T.C. of the Vbe of NPN transistor Q25 and the slight positive T.C. of resistor R12. Currents I1 and I2 are summed at the circuit node defining the collectors of Q23 and Q25, and this sum is forced onto the circuit node by the collector of Q27 via the current mirror defined by transistors Q22 and Q24.

The battery voltage dependent current I4 is established by the series combination of resistor RB and diode-connected transistors Q1–Q5, wherein the current $I_B$ through this string is defined by the equation $I_B=(V_{BATT}-5*Vbe)/RB$. The diode string formed by Q1–Q5 serves two purposes. First, the negative T.C. of the string offsets the slight positive T.C. of the silicon diffused resistor RB to thereby minimize temperature effects thereof on 14. Secondly, the voltage across the diode string Q1–Q5 establishes a non-zero battery voltage $V_{BATT}$ at which the current I4 becomes zero. These two features are used to establish the characteristic slopes and break-over points (i.e., $BV_T$) of the low battery voltage regions of the coil current trip level curves 60–64 shown in FIG. 3. The current $I_B$ is mirrored and scaled by transistors Q5 and Q6 to form the current I4 pulled from the circuit node defined by the collector of Q15. The emitter ratio of Q5 to Q6 advantageously allows reduction of the value of RB thereby minimizing the area required for this device in a silicon integrated circuit.

The current I5 is established by forcing the voltage VBG1 across the silicon diffused resistor R5, wherein the voltage VBG1 is defined by the voltage VBG0 established across the diode-connected transistor Q9 and the silicon diffused resistor R2. The voltage VBG0 is the result of forcing the current IREF through the series connection of Q7, Q8, Q9 and R2. The size of R2 defines the temperature dependence of I5 by forming a relationship between the positive T.C. of R2 and the negative T.C. of the Vbe of Q9. Appropriate choices of emitter areas for Q8 and Q11 as well as the size of R5 establishes substantially identical current densities in transistors Q8 and Q11 so that the Vbe of Q8 is accordingly substantially identical to the Vbe of Q11. The matching of current densities of transistors Q8 and Q11 guarantees that the Vbe of Q8 has a temperature coefficient that is substantially identical to the temperature coefficient of the Vbe of Q11 and also forces the voltage VBG1 to be substantially identical to VBG0. Without the equalities in temperature coefficients of Q8 and Q11, relative shifts in Vbe voltage with temperature would produce undesirable offsets in VBG1. VBG1 establishes the current I5 through R5 that is mirrored by transistors Q10 and Q14 to the circuit node defined by the collector of Q15.

The current I3, defined as the difference between the currents I5 and I4, is forced into the emitter of transistor Q15 having a base tied to two of its four collectors. This configuration causes the current I3 to be equally spit between the two pairs of collectors, whereby one-half of this current is therefore directed to the current mirror composed of transistors Q18 and Q19 (see also FIG. 4) via series connected diodes Q16 and Q17. The remaining one-half of 13 is supplied to the collector of Q18 via transistor Q13. This split configuration arrangement is necessary to allow implementation of the engine speed feature (provided by the signal SPD) which modifies the reference voltage $V_{TH}$ at high engine speeds. The SPD input controls this feature by switching transistors Q12 and Q30 on when SPD is in a logic high state. In one preferred embodiment, transistors Q15 and Q24 are configured such that when transistors Q12 and Q30 are switched on, one-half of the current I3 is pulled from transistor Q15 and one-half of the composite current I1+I2 is pulled from transistor Q24, thereby reducing the re of the value present when SPD is in a logic low state. Specifically, when switched on by a logic high SPD signal, transistor Q12 draws one-half of the Q15 emitter current to ground by pulling the base and collector of Q13 to near ground potential. In this mode, the emitter-base junction of Q13 becomes reverse biased preventing any further current from the two collectors tied to the collector-base of Q13 from reaching the collector of Q18. The diode-connected transistors Q16 and Q17 serve to elevate the operating voltage of Q15 to guarantee proper forward biasing of Q13 when Q12 is off. Likewise, and independently of the foregoing operation of Q12, Q13 and Q15, transistor Q30 is operable to draw one-half of the Q24 emitter current to ground when switched on by an active SPD signal by pulling the base and collector of Q26 to near ground potential. The remaining Q24 current reaches $R_{TRIP}$ via two paths. The first path is directly through diode-connected transistors Q27 and Q28, and the second path is first through diode-connected transistor Q29 and then through Q27 and Q28. The second path through transistor Q29 is provided to allow a reduction of the current I6 for purposes of providing switching hysteresis in the coil current trip control strategy. When the output of the trip comparator 68, composed of transistors Q32–Q38, switches high, transistor Q31 is turned on, thereby drawing ¼ of the output current of Q24 to ground and correspondingly reducing $V_{TH}$ by a magnitude sufficient to provide adequate hysteresis in the coil current trip control strategy. When Q31 is on, Q29 is reversebiased to allow removal of ¼ of the output current of Q24 without altering the other combination of currents formed at the circuit node defined by the collector of Q27.

Alternatively, transistor Q15 may include any desired number of collectors connected to transistors Q16 and Q12 and Q24, may likewise include any desired number of collectors connected to transistors Q19 and Q30, to thereby establish a corresponding desired fraction of the reference voltage $V_{TH}$ when SPD is in a logic high state. In any case, equal amounts of the composite current I1+I2 and the current I3 should be subtracted from the final current I6 to thereby provide a desired reduction in the reference voltage $V_{TH}$ without affecting the temperature coefficient or battery voltage dependency thereof. As described hereinabove with respect to FIG. 2, the foregoing speed mode of operation is preferably invoked at engine speeds above a threshold engine speed to thereby reduce the trip voltage level $V_{TRIP}$ and correspondingly reduce heating of the ignition coil at high engine speeds.

In any case, the current I6 established at the circuit node defined by the collector of Q27 is the sum of I1 and I2 less the current I3. This resultant current is forced onto $R_{TRIP}$ via Q27 and Q28 to thereby establish the reference voltage $V_{TH}$ thereacross. The voltage $V_{TH}$ is applied to the base of Q33, corresponding to the inverting node of comparator 68, and the sense voltage $V_S$ (see FIG. 2) is applied to the base of Q36, corresponding to the non-inverting input of comparator 68. When the sense voltage $V_S$ exceeds $V_{TH}$, the comparator 68 switches high producing a logic high level $V_{TRIP}$ signal used for controlling the gate drive circuit 20 as described hereinabove.

It should now be apparent from the foregoing that the voltage trip circuit 54 of the present invention provides for a battery voltage and temperature dependent signal for controlling the charging time of an automotive ignition coil. In accordance with one set of battery voltage and temperature dependent coil current switching requirements shown herein, the coil current trip level should have only a temperature dependence at higher battery voltages. This temperature dependence is set up by the relative magnitudes of the positive and negative T.C. currents of I1 and I2, wherein calculations necessary to establish such magnitudes are within the knowledge of a skilled artisan. Under high battery voltage conditions, I4 is greater than I5 and the composite current I3 is therefore zero so that $V_{TH}$ is not dependent upon battery voltage $V_{BATT}$. As battery voltage decreases, I5 becomes greater than I4, causing the reference voltage $V_{TH}$ to be correspondingly reduced. This reduction is battery voltage dependent and, depending upon the choice of construction of $R_{TRIP}$, can also be temperature dependent. If $R_{TRIP}$ is a relatively temperature independent resistor (e.g., discrete resistor external to an integrated circuit containing circuit 54), the reduction in $V_{TH}$ due to reduction in battery voltage will have the same temperature dependency, thereby providing for converging coil current trip levels with changing battery voltage as illustrated in FIG. 3.

However, if $R_{TRIP}$ is a silicon diffused resistor of the type used elsewhere in circuit 54, circuit 54 will be immune to silicon resistor process variations. This is because all currents internal to circuit 54 will scale proportionally with varying resistor process, thereby canceling any process-induced variations. This ratiometric behavior is desirable in some implementations since it eliminates any need to adjust or "trim" the circuit to remove any offsets produced by silicon processing variations. Such tracking of the internal resistors allows the behavior of circuit 54 to be set up such that, other than the break-over voltages (e.g., $BV_T$), the temperature dependence of $V_{TH}$ at lower battery voltages can be defined to have the same proportional reduction in trip level with temperature as is defined for the higher battery voltages. This type of set up would be ideal in applications wherein the coil current trip level curves of FIG. 1 are parallel at voltages below $BV_T$.

While the invention has been illustrated and described in detail in the foregoing drawings and description, the same is to be considered as illustrative and not restrictive in character, it being understood that only the preferred embodiments have been shown and described and that all changes and modifications that come within the spirit of the invention are desired to be protected. For example, it is to be understood that calculations necessary to establish the required temperature coefficients and/or battery voltage dependencies for the currents involved in circuit 54 require knowledge of the resistance characteristics of the particular ignition coil being implemented as well as the temperature characteristics of the integrated silicon circuitry used to construct circuit 54. Such calculations necessary to establish the required currents are within the knowledge of a skilled artisan.

What is claimed is:

1. An ignition control circuit, comprising:

a comparator circuit defining a first input receiving a variable input signal, a second input and an output producing a trip signal;

a first circuit producing a first current as a function of temperature; and a second circuit producing a second current, said second current a function of battery voltage below a predefined battery voltage threshold and otherwise zero, said first and second currents combining at said second input of said comparator circuit to define a reference level at which said trip signal changes state in response to said variable input signal.

2. The ignition control circuit of claim 1 wherein said first current is a sum of a third current and a fourth current, said third current having a positive temperature coefficient and said fourth current having a negative temperature coefficient.

3. The ignition control circuit of claim 2 wherein said second current is a difference between a fifth current and a sixth current, said fifth current a function of temperature, said sixth current a function of battery voltage.

4. The ignition control circuit of claim 2 wherein said second circuit includes a current supplying circuit receiving said fifth current and having said sixth current drawn therefrom, said second current equal to said difference between said fifth and sixth currents when said fifth current is greater than said sixth current and otherwise equal to zero.

5. The ignition control circuit of claim 4 wherein said fifth current has a negative temperature coefficient;

and wherein said sixth current has a temperature coefficient associated therewith, said temperature coefficient associated with said sixth current defining a temperature function of said battery voltage threshold.

6. The ignition control circuit of claim 5 further including a third circuit responsive to a first state of a control signal to reduce each of said first and second currents to a predefined fraction thereof.

7. The ignition control circuit of claim 6 further including a fourth circuit producing said control signal as a function of engine speed, said first state of said control signal corresponding to an engine speed above a predefined engine speed threshold.

8. The ignition control circuit of claim 1 wherein said battery voltage threshold is a function of temperature.

9. The ignition control circuit of claim 1 wherein said battery voltage threshold has a negative temperature coefficient.

10. The ignition control circuit of claim 1 further including a resistor connected to said second input of said comparator;

wherein said reference level is a reference voltage defined across said resistor by forcing a difference between said first and second currents therethrough.

11. The ignition control circuit of claim 10 further including a gate drive circuit responsive to a spark control signal to activate an ignition coil driving device causing an increasing coil current to flow through an ignition coil and define a sense voltage corresponding to said variable input signal across a sense resistor;

wherein said trip signal changes state when said sense voltage increases to said reference voltage;

and wherein said gate drive circuit is responsive to said change of state of said trip signal to deactivate said ignition coil driving device.

12. An ignition control circuit, comprising:

a comparator circuit defining a first input receiving a variable input voltage, a second input and an output producing a trip signal;

a first circuit supplying a reference voltage to said second input of said comparator, said reference voltage a function of temperature and of battery voltage and defining a reference level at which said trip signal changes state; and a second circuit responsive to a control signal to reduce said reference voltage to a predefined fraction thereof.

13. The ignition control circuit of claim 12 further including a third circuit producing said control signal as a function of engine speed, said first state of said control signal corresponding to an engine speed above a predefined engine speed threshold.

14. The ignition control circuit of claim 12 further including a gate drive circuit responsive to a spark control signal to activate an ignition coil driving device causing an increasing coil current to flow through an ignition coil and define a sense voltage corresponding to said variable input voltage across a sense resistor;

wherein said trip signal changes state when said sense voltage increases to said reference voltage;

and wherein said gate drive circuit is responsive to said change of state of said trip signal to deactivate said ignition coil driving device.

* * * * *